United States Patent [19]

Mattei et al.

[11] Patent Number: 4,555,281

[45] Date of Patent: Nov. 26, 1985

[54] METHOD FOR AUTOMATICALLY SETTING AND JOINING REEL-FED LABEL STRIPS OR SIMILAR

[75] Inventors: Riccardo Mattei, Bologna; Roberto Osti, Zola Predosa, both of Italy

[73] Assignee: G.D Societa' per Azioni, Bologna, Italy

[21] Appl. No.: 661,247

[22] Filed: Oct. 15, 1984

[30] Foreign Application Priority Data

Oct. 28, 1983 [IT] Italy ..... 3598 A/83

[51] Int. Cl.[4] ..... B65H 69/06

[52] U.S. Cl. ..... 156/64; 156/157; 156/353; 156/361; 156/504; 242/58.1

[58] Field of Search ..... 156/502, 504, 505, 506, 156/361, 157–159, 64; 242/58.1–58.5

[56] References Cited

U.S. PATENT DOCUMENTS

| | | | |
|---|---|---|---|
| 3,514,363 | 5/1970 | Stone et al. | 242/58.1 X |
| 4,067,760 | 1/1978 | Nelson | 156/504 X |
| 4,460,430 | 7/1984 | Kissell et al. | 242/58.4 X |

*Primary Examiner*—David Simmons

*Attorney, Agent, or Firm*—Marshall, O'Toole, Gerstein, Murray & Bicknell

[57] ABSTRACT

Method for automatically setting and joining reel-fed label strips or similar, whereby a first moving strip is first accelerated in relation to the assimilation speed of a user machine and then stopped, by means of a signal supplied by control means in a position whereby its labels correspond with the labels on a second stationary strip. A cutting unit is then operated for cutting the said two strips simultaneously along a cutting line. Subsequent operation of a joining unit then joins the said two strips along the said cutting line.

4 Claims, 4 Drawing Figures

METHOD FOR AUTOMATICALLY SETTING AND JOINING REEL-FED LABEL STRIPS OR SIMILAR

BACKGROUND OF THE INVENTION

The present invention relates to a method for automatically setting and joining reel-fed label strips or similar.

The following description relates, solely by way of a non-limiting example, to the problem of changing label reels automatically on wrapping machines.

On wrapping machines, the running-out label reel is known to be replaced automatically with a new one without stopping the strip running off the old reel.

For this purpose, the strip off the new reel is first accelerated to bring it up to the speed of the old strip and then set in relation to the latter so that one of its labels corresponds with a label on the old strip.

Subsequently, cutting means, usually travelling together with the strips, cut the latter along a separating line between two adjacent labels, after which, one end of the new strip upstream from the cutting line is joined to one end of the old strip downstream from the said cutting line. The aforementioned setting and joining method involves a number of drawbacks and, consequently, very high running cost, owing to the fact that, being a moving system, it can only be implemented with the aid of highly sophisticated electronic equipment the mechanical output of which involves serious complications in terms of structure. Furthermore, the environment in which the said wrapping machines are usually operated is such that reliability of both the electronic equipment and the connected mechanical units is relatively poor and maintenance cost and downtime often unacceptable.

SUMMARY OF THE INVENTION

The aim of the present invention is to provide a method of setting and joining two strips involving none of the aforementioned drawbacks.

With this aim in view, the present invention relates to a method for automatically setting and joining reel-fed label strips or similar, the said method comprising stages consisting in:

feeding a first strip off a first reel to a user maching through a joining unit, a cutting unit and a strip feed unit, all located between the said first reel and the said user machine;

arranging a second strip off a second reel in an idle position in which the said second strip overlaps the said first strip and extends through the said joining unit and the said cutting unit;

feeding the said first strip, in response to a signal indicating imminent runout of the said first reel, at a speed greater than the assimilation speed of the said user machine, in such a manner as to create a reserve between the latter and the said feed unit;

activating means controlling the location of the said first strip, so as to stop the said feed unit when a label on the said first strip coincides with a label on the said second strip;

activating the said cutting unit so as to cut the said two strips simultaneously;

activating the said joining unit so as to join one end of the said second strip upstream from a cutting line on the said cutting unit to one end of the said first strip downstream from the said cutting line; and restarting the said feed unit.

BRIEF DESCRIPTION OF THE DRAWINGS

A number of non-limiting arrangements of the present invention will now be described with reference to the attached drawings in which.

DETAILED DESCRIPTION OF THE INVENTION

Figure 1:
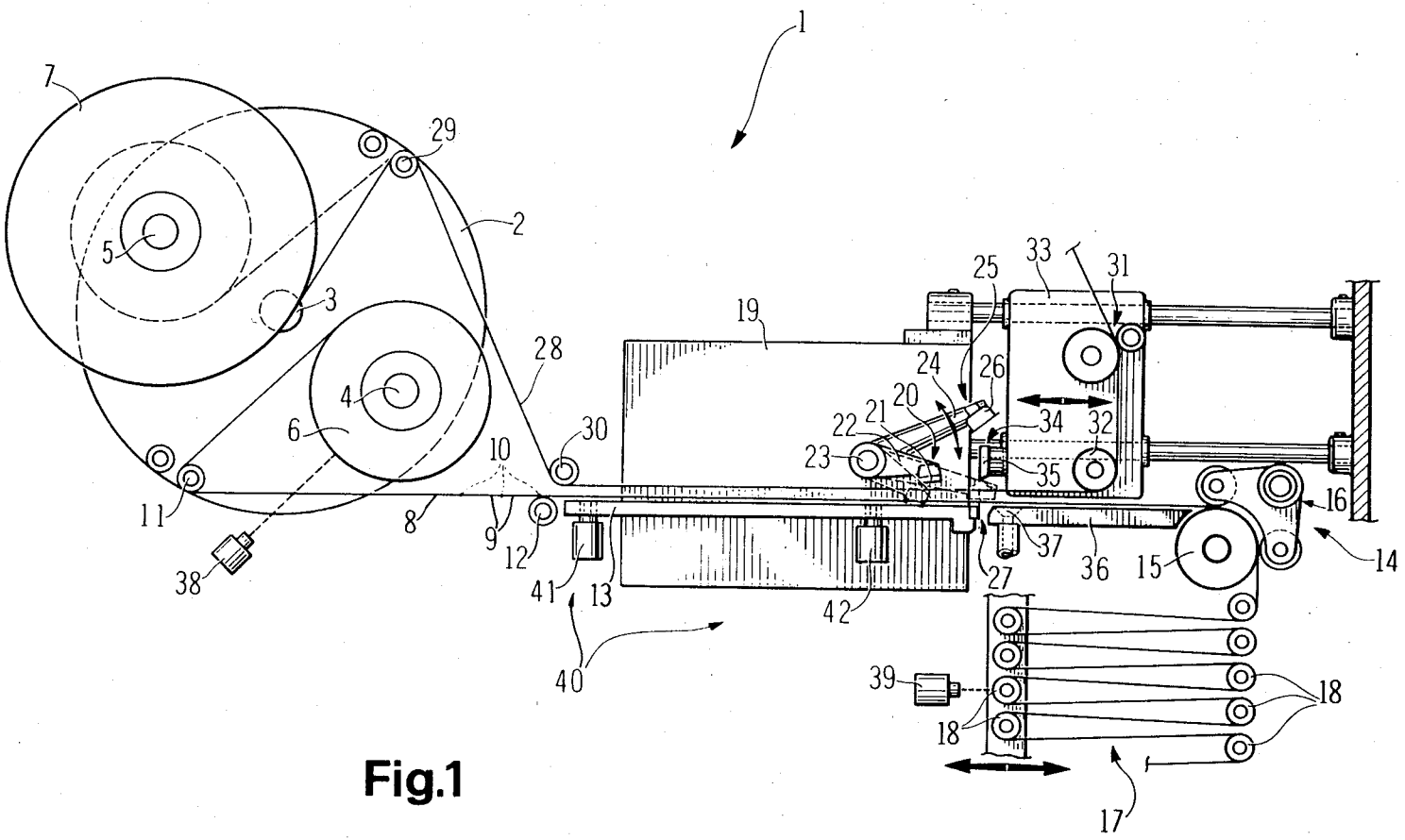
FIG. 1 shows a side view of a preferred arrangement of an automatic reel-change device for implementing the method according to the present invention.

Number 1 in FIG. 1 indicates a reel-change device on a wrapping machine (not shown).

Device 1 comprises a disc 2 mounted so as to turn round its own centre axis 3 and supporting, in eccentric and diametrically-opposed manner, two shafts, 4 and 5, supporting respective idle reels 6 and 7.

Figure 2:
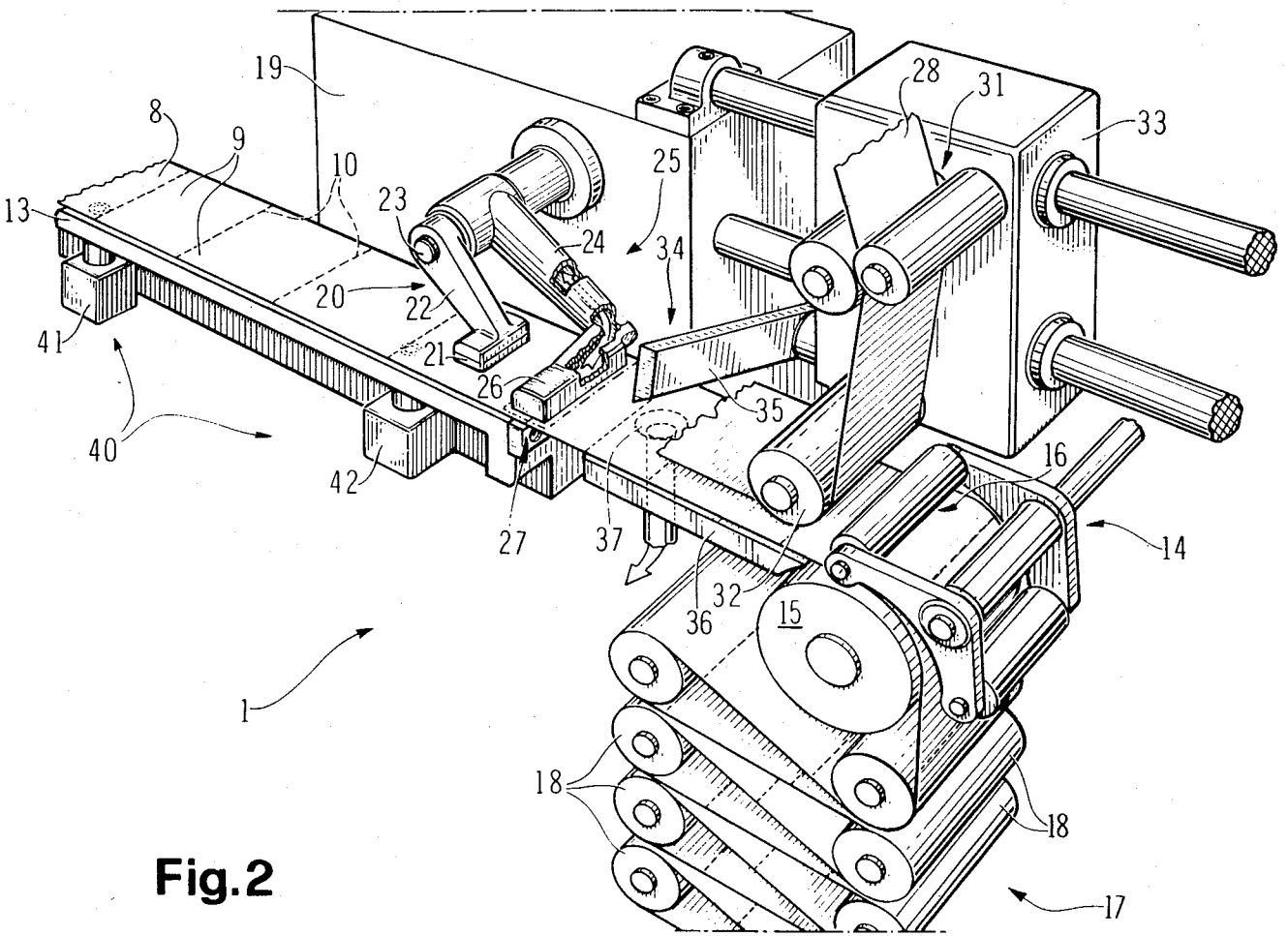
FIG. 2 shows a view in perspective of a detail in FIG. 1.

Reel 6, also referred to as the first reel, consists (see also FIG. 2) of strip 8, also referred to as the first strip and formed of labels 9, arranged in succession and connected integral with one another along separating lines 10.

When wound off reel 6, strip 8 is first wound round transmission pin 11 and then fed in an essentially horizontal direction over guide roller 12 and along bench 13 downstream from which provision is made for feed unit 14. The latter comprises a drive roller 15 against which strip 8 is pressed by pressure element 16. Downstream from feed unit 14, strip 8 is connected to user units (not shown) on the wrapping machine (not shown) via an expansible storage unit 17 comprising, in known manner, a number of rollers 18 moving crosswise in relation to one another for varying the length of the strip wound round them. Over bench 13, provision is made for a support 19 to which is connected a mobile stop device 20 comprising a pad 21 mounted on a lever 22 so as to turn round pin 23 between a top idle position and a bottom working position in which pad 21 exerts a given pressure on bench 13. Coaxial with pin 23 is mounted, in rotary manner, a lever 24 of joining unit 25 comprising a pad 26 mounted on the end of lever 24 and designed to retain by suction an adhesive strip (not shown).

Lever 24 is designed to move round the axis of pin 23 between a top idle position and a bottom working position in which pad 26 exerts a given pressure on bench 13 on a crosswise slit 27 in the said bench, the said slit hereinafter being called the "cutting line".

Reel 7, also referred to as the second reel, consists of strip 28, also referred to as the second strip and which unwinds round a diverting pin 29 on disc 2 and then round a diverting roller 30 essentially located over roller 12. Downstream from roller 30, strip 28 extends parallel with and over strip 8, in a stationary position between bench 13 and joining unit 25. One end of strip 28 extends downstream from cutting line 27 and is supported by a supporting element consisting of grip unit 31 comprising a bottom diverting roller 32 on carriage 33.

Strip 28 is usually positioned manually along bench 13 by setting a given reference line on label 9 of strip 28 so as to coincide with cutting line 27.

Upstream from grip unit 31, carriage 33 supports a cutting unit 34 comprising a blade 35 moving crosswise with carriage 33 between a first position, aligned with cutting line 27, and a second position downstream in relation to the said cutting line 27. When carriage 33 is in the said first position, blade 35 moves vertically, in relation to carriage 33, between a top idle position and a bottom working position in which blade 35 engages cutting line 27.

One portion 36 of bench 13 downstream from cutting line 27 is provided with suction elements 37 adjacent with the said cutting line 27 and connected to a suction source not shown.

Adjacent with disc 2, device 1 is provided with a sensor 38 designed to emit a signal when reel 6 is about to run out. Device 1 is also provided with a second sensor 39 designed to control the crosswise position of rollers 18 and to emit a reserve-formation signal when store 17 accumulates the maximum allowance of strip 8.

Underneath strip 8, bench 13 supports a control unit 40 comprising control means consisting of a first photocell 41, set up in a fixed position in relation to bench 13, and a second photocell 42 the position of which in relation to bench 13 may be adjusted in the feed direction of strip 8. When activated, photocells 41 and 42 emit a signal in response to reference marks (not shown) on strip 8 passing in front of them.

In response to the signal emitted by sensor 38 to show reel 6 is about to run out, feed unit 14 is accelerated in such a manner that the amount of strip 8 run off reel 6 per unit of time exceeds the amount assimilated by the user machine (not shown) thus enabling the formation of a reserve in store 17.

In response to the reserve-formation signal emitted by sensor 39, feed unit 14 is slowed down and photocells 41 and 42 activated. When both of the latter detect simultaneously the passage of a respective reference mark (not shown) on strip 8, they stop feed unit 14 and strip 8 simultaneously, in such a maner that cutting line 27 coincides with a reference line on a label 9 corresponding with the said reference line on the label 9 of strip 28 stopped astride cutting line 27. Thus, when strip 8 is also stopped, labels 9 on the latter coincide perfectly with labels 9 on strip 28.

The said reserve-formation signal also causes simultaneous operation of stop device 20, the lever 22 of which moves down so as to cause pad 21 to grip strips 8 and 28 on bench 13. The signal emitted by photocells 41 and 42 then activates the suction source (not shown) connected to suction elements 37, and moves blade 35 down from the top idle position into the bottom cutting position. When thus operated, blade 35 cuts strips 8 and 28 simultaneously along the said matching reference lines coinciding with cutting line 27. When blade 35 moves back up into the idle position, carriage 33 moves from the position shown in FIGS. 1 and 2 towards feed unit 14. At the same time, the cut part of strip 28 downstream from cutting line 27 is moved away and lever 24 moved down, thus causing pad 26 on the said lever to affix the said adhesive strip (not shown) on to strips 8 and 28, astride cutting line 27, so as to join the part of strip 28 upstream from cutting line 27 to the part of strip 8 downstream from the said line 27. When levers 22 and 24 move back up, suction elements 37 are de-activated and feed unit 14 re-activated and brought gradually up to operating speed. The reason for providing control unit 40 with two or more photocells is that, for printing purposes, commonly-used strips are usually provided with more than one set of reference marks, the mutual location of which varies from one strip to another.

Figure 3:
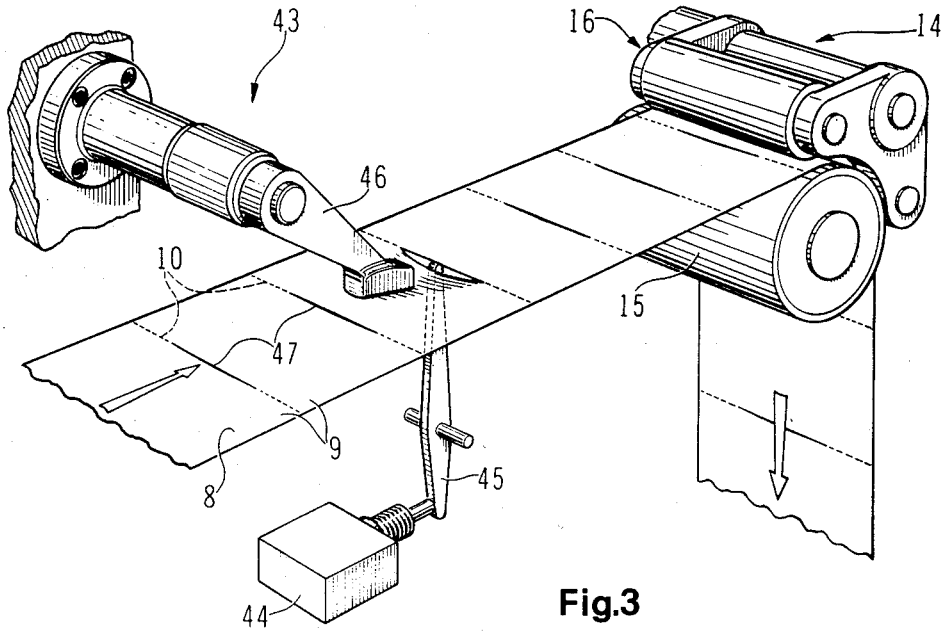
FIG. 3 shows a view in perspective of a variation of a further detail in FIG. 1.

In the variation shown in FIG. 3, control unit 40 is replaced by an electromechanical control unit 43 on which the signal, emitted on unit 40 by photocells 41 and 42, is emitted by a microswitch or stop means 44 activated by a control means consisting of a lever 45 downstream from cutting line 27. Lever 45 is activated by a parting means, consisting of lever 46, moving down on to strip 8 from a top idle position into a working position, in which one end of lever 46 pushes strip 8 downwards so as to part the adjacent edges of a slit 47 provided on strip 8 on each separating line 10. When thus parted, the edge upstream from slit 47 moves down to engage the free end of lever 45 which activates microswitch 44.

Obviously, when levers 22 and 24 move back up, lever 46 also moves back up at the same time.

Figure 4:
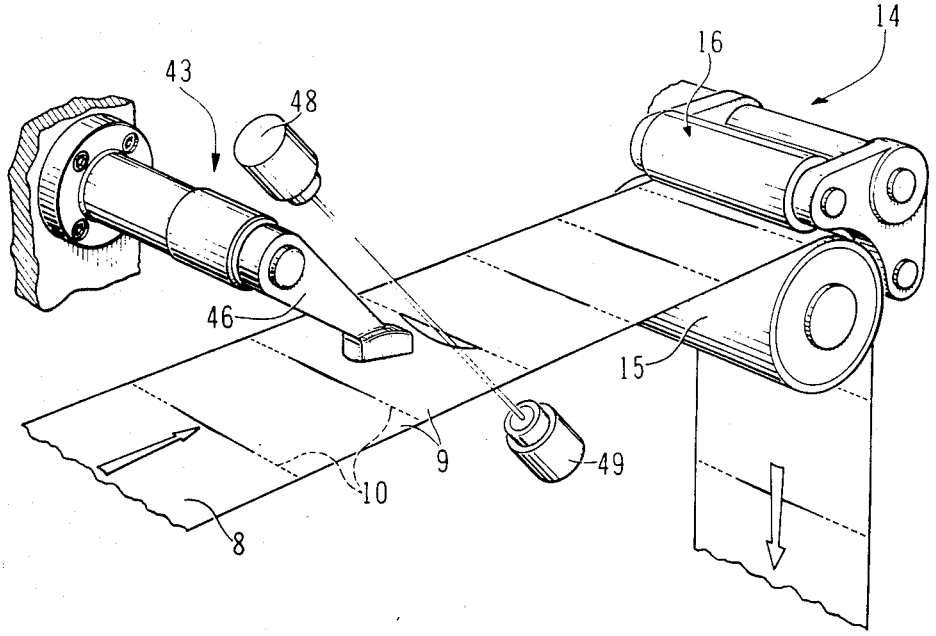
FIG. 4 shows a view in perspective of a variation of the FIG. 3 detail.

In the variation shown in FIG. 4, lever 45 and stop means 44 are replaced by a signal emitter 48 and a signal receiver 49, e.g. optical, shielded by strip 8 and communicating through an opening formed when the adjacent edges of the said slit 47 are parted by lever 46.

We claim:

1. A method for automatically setting and joining reel-fed label strips or similar, each said label being joined to adjacent labels along separating lines (10) each including a slit (47), the method comprising:

feeding a first label strip (8) off a first reel (6) to a user machine through a joining unit (25), a cutting unit (34) and a strip (8) feed unit (14), all located between the said first reel (6) and the said user machine;

arranging a second label strip (28) off a second reel (7) in an idle position in which the said second strip (28) over laps the said first strip (8) and extends through the said joining unit (25) and the said cutting unit (34);

feeding the said first strip (8), in response to a signal indicating imminent runout of the said first reel (6), at a speed greater than the assimilation speed of the said user machine, in such a manner as to create a reserve between the latter and the said feed unit (14);

activating parting means (46) for parting the edges of one said slit (47) on said first strip (8), and for activating control means (45,48,49) controlling the location of the said first strip (8), so as to stop the said feed unit (14) when a label (9) on the said first strip (8) coincides with a label (9) on the said second strip (28);

activating the said cutting unit (34) so as to cut the said two strips (8,28) simultaneously;

activating the said joining unit (25) so as to join one end of the said second strip (28) upstream from a cutting line (27) on the said cutting unit (34) to one end of the said first strip (8) downstream from the said cutting line (27); and restarting the said feed unit (14).

2. Method according to claim 1, characterised by the fact that the said parting means (46) are set up along the supply line of the said first strip, downstream from the said cutting unit (34).

3. Method according to claim 1, characterised by the fact that the said control means comprise a lever (45)

engaged by the said parted edge, so as to move from a normal idle position into a work position.

4. Method according to claim 1, characterised by the fact that the said control means comprise a signal emitter (48) and a signal receiver (49) shielded by the said first strip (8) and communicating through an opening formed by the said parting means (46) through the said first strip (8) by parting the edges of the said slit (47).

* * * * *